US008696422B1

(12) United States Patent
Santiago

(10) Patent No.: US 8,696,422 B1
(45) Date of Patent: Apr. 15, 2014

(54) ELECTRONIC BOXING GAME, GEAR, METHOD AND SYSTEMS

(76) Inventor: Rafael Santiago, Titusville, FL (US)

( * ) Notice: Subject to any disclaimer, the term of this patent is extended or adjusted under 35 U.S.C. 154(b) by 0 days.

(21) Appl. No.: 13/554,449

(22) Filed: Jul. 20, 2012

(51) Int. Cl.
*A63F 13/10* (2006.01)

(52) U.S. Cl.
USPC ..... 463/8; 463/7; 463/35; 463/47.1; 463/47.2; 463/47.3; 273/455; 473/518; 473/570

(58) Field of Classification Search
USPC ..... 463/1, 8, 47.1–47.7, 7, 35, 39; 273/454–455; 473/518, 570
See application file for complete search history.

(56) References Cited

U.S. PATENT DOCUMENTS 3,235,259 A 2/1966 Glass
4,824,107 A 4/1989 French
4,995,610 A 2/1991 Paoletti
6,056,674 A 5/2000 Cook
6,925,851 B2 * 8/2005 Reinbold et al. ..... 73/12.09
8,485,879 B2 * 7/2013 Lin et al. ..... 463/8
2002/0037759 A1 * 3/2002 Aldridge ..... 463/1
2005/0014542 A1 1/2005 Ueshima
2012/0279311 A1 * 11/2012 Helmer et al. ..... 73/768

FOREIGN PATENT DOCUMENTS

WO WO2007011145 * 1/2007 ..... A63B 71/08

* cited by examiner

*Primary Examiner* — Sunit Pandya
(74) *Attorney, Agent, or Firm* — Brian S. Steinberger; Law Offices of Brian S. Steinberger, P.A.

(57) ABSTRACT

Devices and systems and methods that can include padded vest and head gear having sensors to be worn by opposing players, for a boxing game and training system and method wherein impacts on the sensors are automatically converted into points on a scoreboard. The sensors can be located on left and right sides of the headgear and on upper and lower portions of the front of the vest of the participants.

18 Claims, 8 Drawing Sheets

ELECTRONIC BOXING GAME, GEAR, METHOD AND SYSTEMS

FIELD OF INVENTION

This invention relates to boxing, and in particular to devices and systems and methods that can include padded chest and head gear having sensors to be worn by opposing players, for a boxing game and training system and method wherein impacts on the sensors are automatically converted into points on a scoreboard.

BACKGROUND AND PRIOR ART

Various types of impact sport games have been proposed over the years with some directed toward boxing. For example, U.S. Pat. No. 3,235,259 to Glass et al. and U.S. Pat. No. 4,995,610 to Paoletti each toy boxing games, where players control small toy boxing robots. Although the fighting toy boxer games may be fun, they do little to teach and enhance boxing skills and offer no remedial exercise value. Similarly, the more popular video game systems offer video images of boxers.

Video game versions of boxers have also been done over the years. See for example, U.S. Patent Application Publication 2005/0014542 to Ueshima. Similar to toy boxers, the video games may be fun, they do little to teach and enhance boxing skills and offer no remedial exercise value.

Attempts at having wearable clothing with sensors have been attempted over the years. See For example, U.S. Pat. No. 4,824,107 to French. However, the French reference is generally limited to fencing and martial arts type games of those involving baseball, softball, tennis, hockey, golf. However, there is no teaching or description for use with boxing.

U.S. Pat. No. 6,056,674 to Cook shows and describes a "method and apparatus for boxing", title. However, the headgear requires an elaborate full front face protecting members that covers and blocks out the nose, mouth, and chin with either rigid plastic or metal guards with narrow slot region for the eyes. Such elaborate headgear would be undesirable to be worn by users. Sensors are imbedded in clothing and are not used as contact targets. In addition, Cook requires a display on the forehead of the participant, which would be distracting to the opposing player. Cook uses sensors in the gloves which makes those sensors more prone to damage since they are constantly being hit. Additionally, Cook uses transmitters to send signals out that are in close proximity to the sensors which appears to be in the clothing on the front side of the wearer, which allows for the transmitters to be more easily damaged by the blows of the opposing player.

Thus, the need exists for solutions to the above problems.

SUMMARY OF THE INVENTION

A primary objective of the present invention is to provide devices and systems and methods that can include padded chest and head gear having sensors to be worn by opposing players, for a boxing game and training system and method wherein impacts on the sensors are automatically converted into points on a scoreboard.

A secondary objective of the present invention is to provide a boxing game and training system having headgear with contact scoring sensors, where the headgear does not obstruct, the eyes, nose, mouth and chin of the participants.

A third objective of the present invention is to provide a boxing game and training system having headgear and vests with contact scoring sensors, where the sensors are target points on the outside of the headgear and vests.

A fourth objective of the present invention is to provide a boxing game and training system having headgear and vests with contact scoring sensors, having a transmitter located on the back of the participants to send contact scores to a remote display.

A fifth objective of the present invention is to provide a boxing game and training system having headgear and vests with contact scoring sensors, which sends scores to a remote wall mounted display.

A sixth objective of the present invention is to provide a boxing game and training system having headgear and vests with contact scoring sensors, which sends scores to a remote wall mounted display.

A boxing game and training system, can include a head gear having a cap portion adapted to cover a top of a participant's head, and side portions adapted to cover sides of the participant's head, the head gear adapted to expose a front of the participant's face so that the participant's nose and chin are not covered, sensors on the side portions of the head gear, a vest having a front portion and a rear portion, the front portion adapted to cover chest and stomach areas of the participant, the rear portion adapted to cover a back of the participant, sensors on the vest, a transmitter attached to the headgear sensors and to the vest sensors, the transmitter mounted on the rear portion of the vest, a remote receiver for receiving wireless transmissions from any external contacts with the headgear sensors or with the vest sensors, and a remote display for displaying contact scores from the headgear sensors and from the vest sensors.

The boxing game and training system can further include a second head gear having a cap portion adapted to cover a top of a second participant's head, and side portions adapted to cover sides of the second participant's head, the head gear adapted to expose a front of the second participant's face so that the second participant's nose and chin are not covered, second sensors on the side portions of the second head gear, a second vest having a front portion and a rear portion, the front portion adapted to cover chest and stomach area of the second participant, the rear portion adapted to cover a back of the participant, second sensors on the second vest, a second transmitter attached to the second headgear sensors and to the second vest sensors, the second transmitter mounted on the rear portion of the second vest, and a second remote receiver for receiving wireless transmissions from any external contacts with the headgear sensors or with the vest sensors, wherein the remote display displays contact scores from the second headgear sensors and the second vest sensors.

The headgear can have an inverted U shape with the front of the participant's face left exposed.

One or more of the headgear sensors can be mounted on an exterior surface of a left side of the side portions of the headgear, and another one or more of the headgear sensors can be mounted on an exterior surface of a right side of the side portions of the headgear.

The vest sensors can include a pair of upper vest sensors mounted on exterior surfaces of upper left and right front portions of the vest, and a pair of lower vest sensors mounted on exterior surfaces of lower left and right front portions of the vest.

The rear of the vest can include a horizontal strap for attaching a left side of the vest to the right side of the vest, and shoulder straps for attaching top left and top right portions of the vest to the horizontal strap.

The rear of the vest can include a vertical strap that attaches ends of the shoulder straps to the horizontal strap, and a mount for attaching the transmitter to the vertical strap, so that the transmitter is adapted to be located in a central back portion of the participant.

The remote display can include a raised display displaying boxing rounds and individual contact scores in each round.

The remote display can include a portable computer with display displaying boxing rounds and individual contact scores in each round.

The portable computer can include a laptop computer or a smart phone.

A method for playing a boxing game, can include the steps of providing a head gear having a cap portion adapted to cover a top of a participant's head, and side portions adapted to cover sides of the participant's head, the head gear adapted to expose a front of the participant's face so that the participant's nose and chin are not covered, providing sensors on the side portions of the head gear, providing a vest having a front portion and a rear portion, the front portion adapted to cover chest and stomach areas of the participant, the rear portion adapted to cover a back of the participant, providing sensors on the vest, providing a transmitter attached to the headgear sensors and to the vest sensors, the transmitter mounted on the rear portion of the vest, providing a remote receiver for receiving wireless transmissions from any external contacts with the headgear sensors or with the vest sensors, contacting the headgear sensors and the vest sensors from a second participant so that contact scores, transmitting the contact scores to a remote receiver, and displaying the contact scores from the remote receiver on a display.

The method can further include the steps of providing a second head gear having a cap portion adapted to cover a top of a second participant's head, and side portions adapted to cover sides of the second participant's head, the head gear adapted to expose a front of the second participant's face so that the second participant's nose and chin are not covered, providing second sensors on the side portions of the second head gear, providing a second vest having a front portion and a rear portion, the front portion adapted to cover chest and stomach area of the second participant, the rear portion adapted to cover a back of the participant, providing second sensors on the second vest, providing a second transmitter attached to the second headgear sensors and to the second vest sensors, the second transmitter mounted on the rear portion of the second vest, contacting the second headgear sensors and the second vest sensors from the participant so that contact scores, transmitting the first contact scores to a second remote receiver, and displaying the second contact scores from the second remote receiver on the display.

The method can further include the step of displaying the first and the second contact scores for individual boxing rounds on the display.

The method can further include the step of displaying the first and the second contact scores for the individual boxing rounds on a portable computer.

The method can further include the step of displaying the first and the second contact scores for the individual boxing rounds on a smart phone.

The invention can be used for participants interested in learning to box, and/or wishing to sharpen their boxing skills, and/or for fun and/or for exercise.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
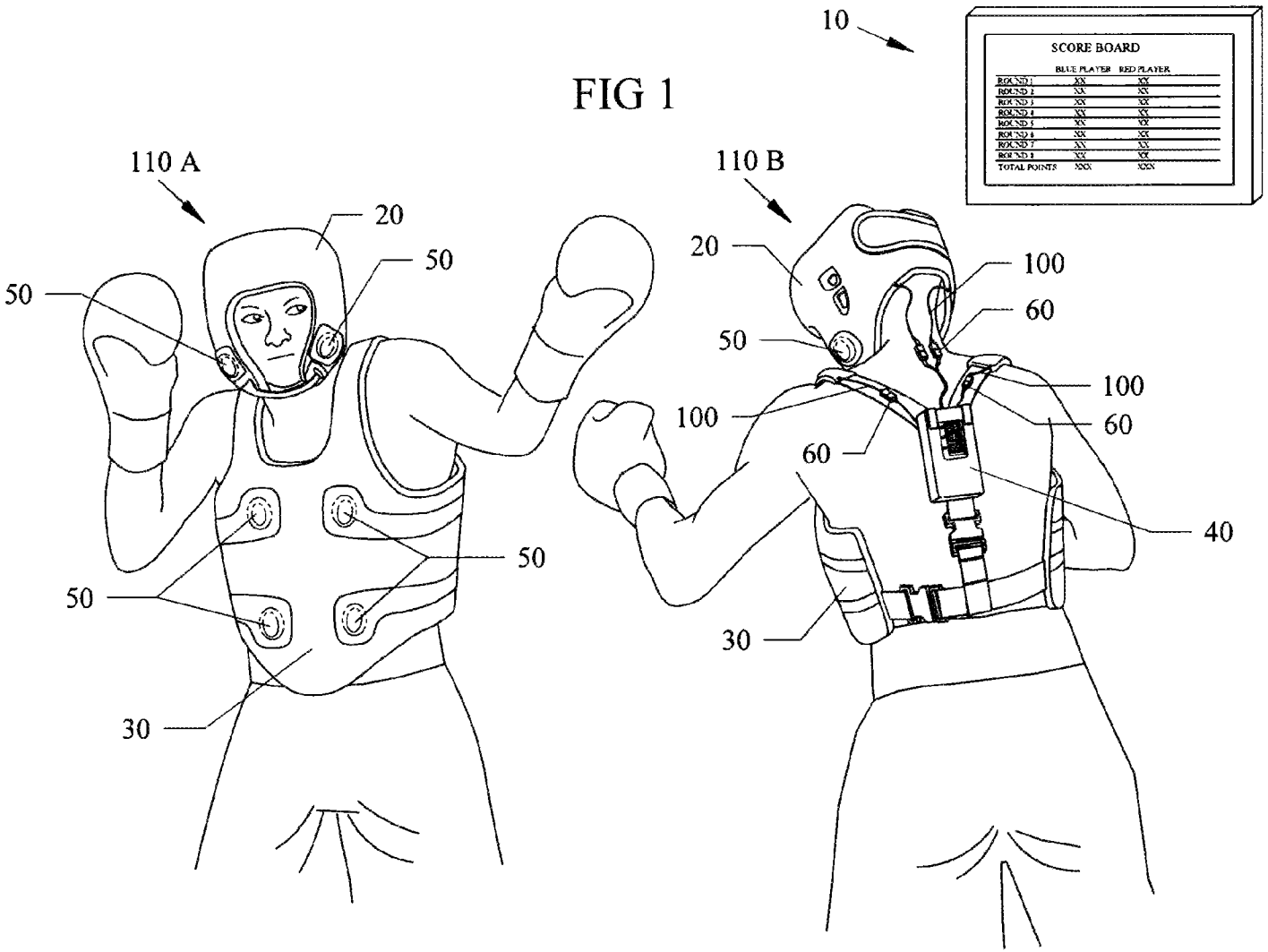
FIG. 1 is a perspective view of two game participants wearing the novel vest and head gear along with wall-mounted wireless electronic scoreboard.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A description of the components will now be described.

10 Wireless electronic scoreboard.
20 Head gear with hit sensors.
22 left side
25. top
28. right side
30 Vest with hit sensors.
31 rear vertical strap
32 left front side and wrap around portion
34 left shoulder portion
35 rear strap
36 right shoulder portion
37 rear strap
38 right front side with wrap around portion
39 rear horizontal strap
40 Hit sensing unit for Hit counts and transmitting device mounted to vest straps.
50 Hit sensor.
60 Connector for transmitting device to hit sensor.
70 Padded vest core material.
80 Protective fabric layer.
90 Leather like material covers and protects hit sensors and sensor wiring.
100 Sensor wiring.
110 Boxing game participant.
120 Optional vest with extended groin protection.
130 Optional thigh pads can have sensors installed for fre-estyle martial arts game play.
140 Optional shin pads.
150 Laptop computer with optional scoring software installed. Computer can communicate wirelessly with counting/transmitting device.

Figure 2:
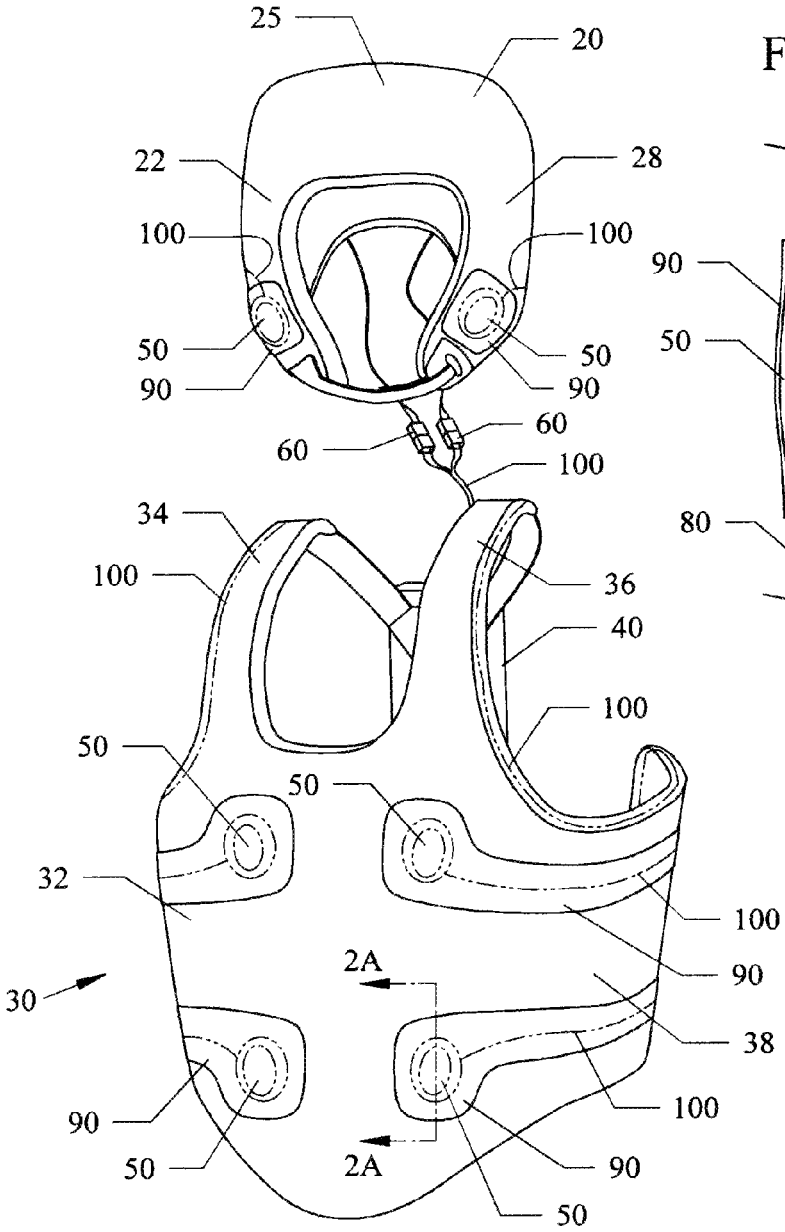
FIG. 2 is a front perspective view of the novel hit sensing headgear and vest.
Figure 2A:
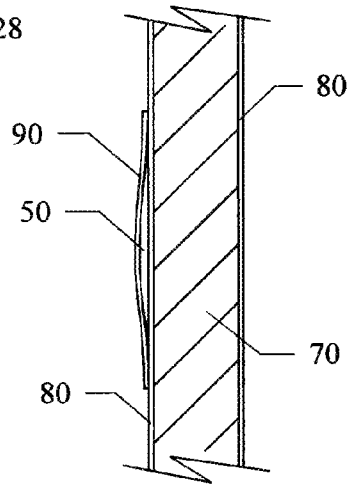
FIG. 2A is an enlarged cross-sectional view of the sensor and vest material of FIG. 2 along arrow 2A.

FIG. 1 is a perspective view of two game participants 110A, 110B wearing the novel vest 30 and head gear 20 along with wall-mounted wireless electronic scoreboard display 10. FIG. 2 is a front perspective view of the novel hit sensing headgear 20 and vest 30. FIG. 2A is an enlarged cross-sectional view of the sensor 50 and vest material 90 of FIG. 2 along arrow 2A.

Figure 3:
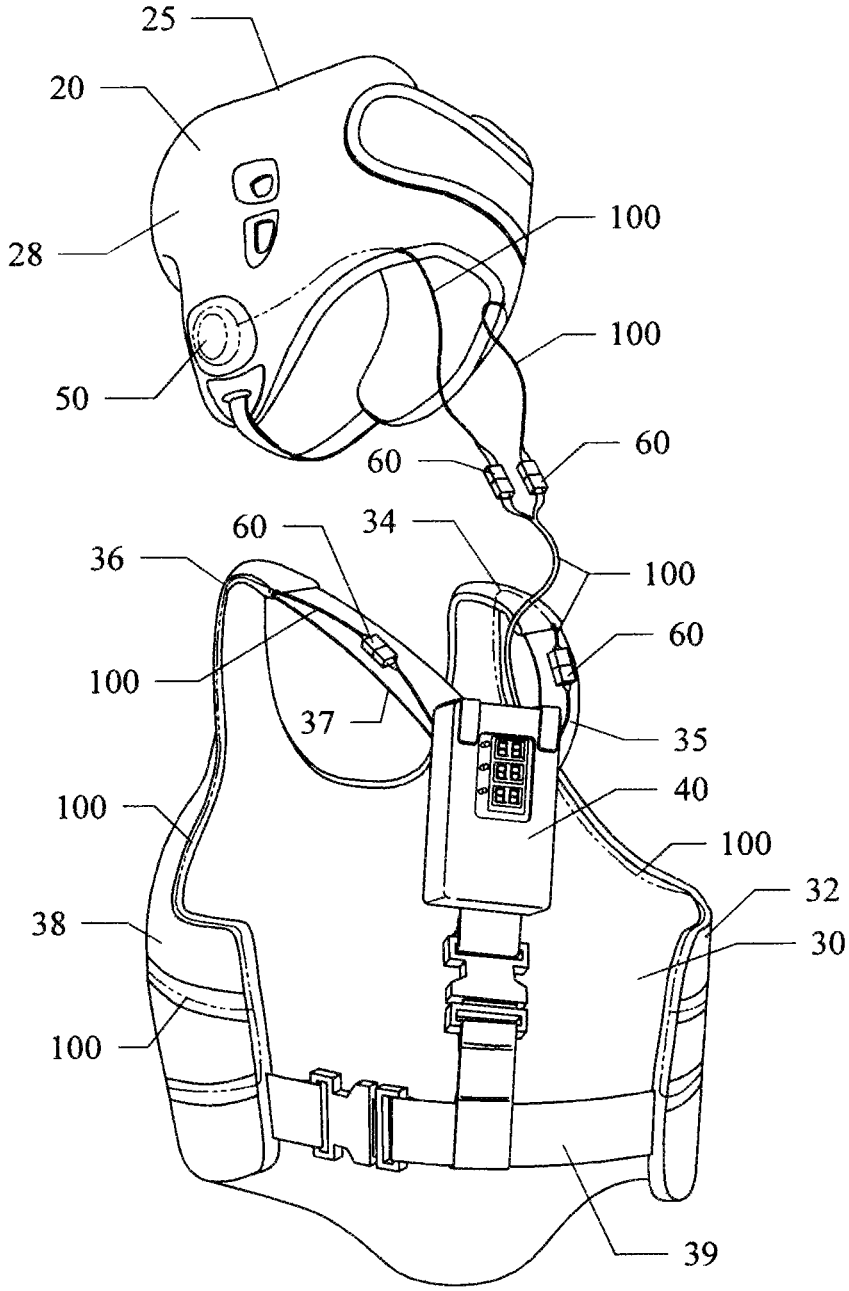
FIG. 3 is a rear perspective view of the hit sensing headgear and vest of FIG. 2. Section detail of hit sensor.
Figure 4:
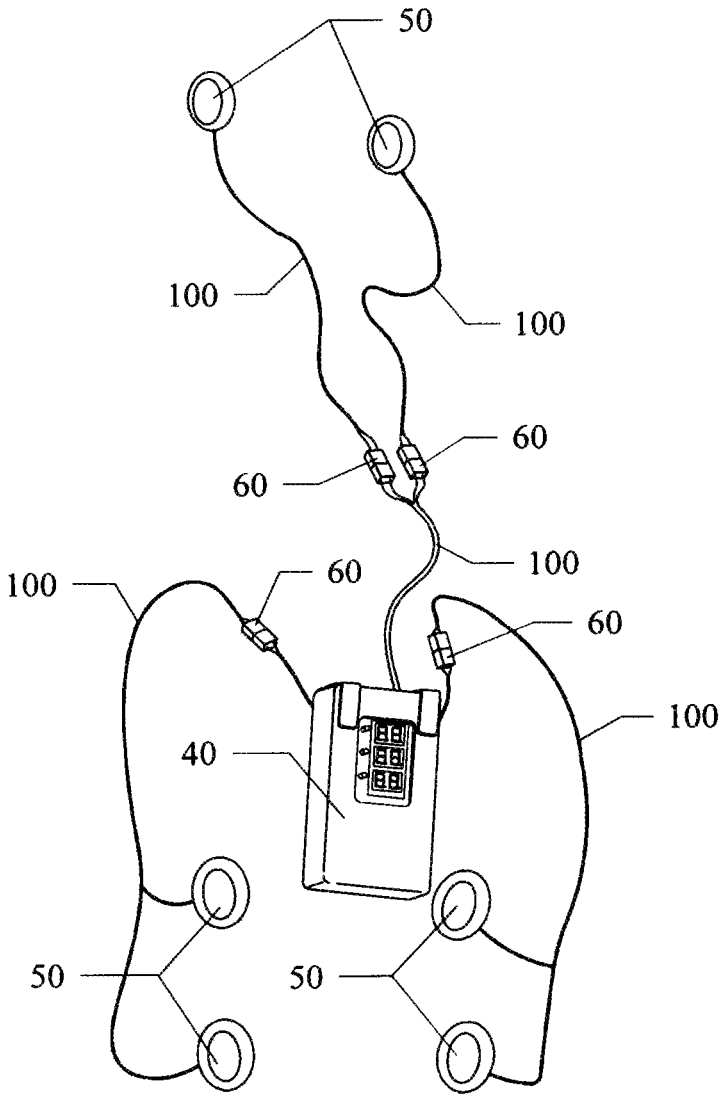
FIG. 4 is a perspective view of hit sensing unit with wiring and connectors linking the sensing unit to the hit sensors all separated from the vest and headgear.

FIG. 3 is a rear perspective view of the hit sensing headgear and vest of FIG. 2. FIG. 4 is a perspective view of hit sensing unit components 40, 50, 60, 100 with wiring and connectors linking the sensing unit 40 to the hit sensors 50 all separated from the vest 30 and headgear 20.

Referring to FIGS. 1-4, the headgear 20 can be formed from a protective fabric type cover layer material 80 that covers both sides of padding 70. For example, the cover material 80 can include but is not limited to a nylon or plastic or canvas material 80 over padding 80, such as but not limited to foam, and the like. The headgear 20 can have an inverted U-shape with left side 22, top head portion 25 and right side 28.

On both the left side 22 and right side 28 can be contact sensors 50, that can be covered by protect covering material 90, such as leather like material which protects both the sensors 50 and sensor wires 100. The cover material 90, especially covering the sensors 50 can be large enough to visually create a visual target area for the other game participant to contact. The sensors 50 can selected from different types of thin diameter impact sensors, such as but not limited to pressure sensors. The sensors 50 can send off signals based on mere contact. Alternatively, the sensors 50 can generate different readings based on impact, so that different scores are given for different impact pressure hits.

When the headgear 20 is worn by a participant, the left side 22, top 25, and right side 28 can cover the left side of the face and right side of the face of the participant. The headgear 20 can cover from the ears to the front cheeks of the participant and would allow for the eyes, nose, chin and front face of the participant to not be covered and obstructed. The left side 22 with sensor 50 and right side 28 with sensor 50 respectively cover the left cheek, left jaw, and right cheek and right jaw of the participant wearing the headgear 20.

The novel vest 30 can include a front portion with left front side and wrap around portion 32, left shoulder portion 34, right shoulder portion 36 and right front side with wrap around portion 38. On the left front side 32 of the vest 30 can a stacked pair of sensors 50 (an upper one, and a lower one) along with protective visual cover material 90. On the right front side 38 of the vest 30 can be another stacked pair of sensors 50 (an upper one, and a lower one) along with protective visual cover material 90.

The left shoulder portion 34 of the vest 30 connects to rear strap 35 and the right shoulder portion 36 connects to rear strap 37. The rear straps 35, 37 form a Y shape to connect to rear vertical strap 31 which connects to a central portion of rear horizontal strap 39.

The rear horizontal strap 39 can wrap about the waist of the participant and attach the wrap around portion of left front side 32 with the wrap around portion of right front side 38. The horizontal strap 39 and the vertical strap 31 can each have interlocking connections (such as male and female connectors) so that the rear straps 31, 39 can be separated from one another to allow for the vest 30 to be easily put on and taken off of participants.

The front vest sensors 50 can be attached by sensor wiring along the side edges of the vest 30 to a combined sensor unit and transmitting unit 40. Connectors 60 can allow for the sensors 50 to be disconnected from the combined sensor unit and transmitting unit 40. The combined sensor and transmitting unit 40 can count the hits (contacts) on the vest sensors 50, and immediately send the signal hits wirelessly to a remote receiver which can be part of a computer display board 10. The combined sensor unit and transmitting unit 40 can be mounted on the rear vertical strap 31 so that the unit 40 is generally centrally located on the back of the participant in a safe location away from the sensors 50.

Figure 5:
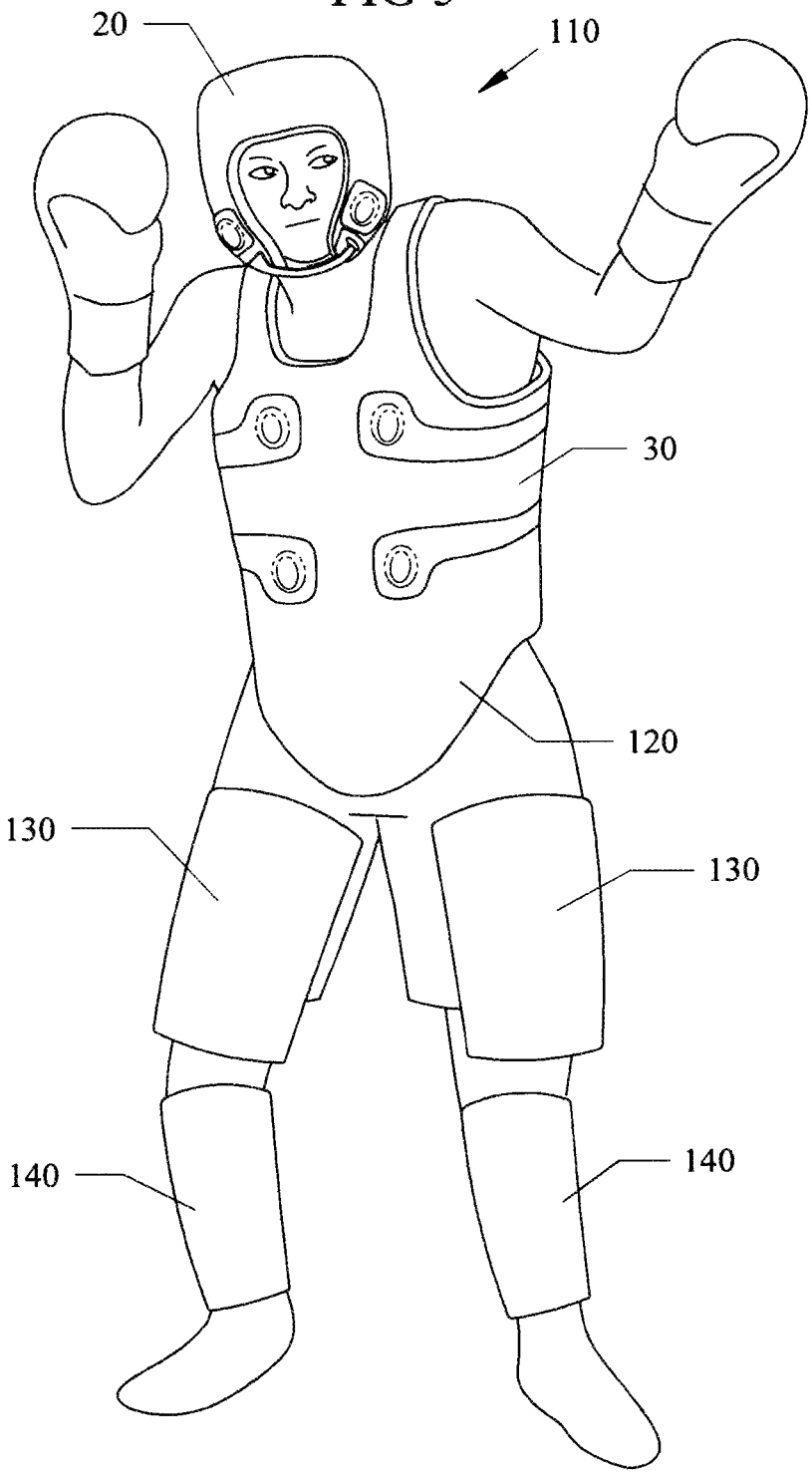
FIG. 5 is a front view of a game participant wearing the novel headgear and vest along with optional extended vest and leg pads.

FIG. 5 is a front view of a game participant 110 wearing the novel headgear 20 and vest 30 along with optional extended vest groin protection area 120 and thigh padding area 130 and chin padding area 140. These extra pad areas 130, 140 can also have sensors 50 with target protective cover material 90, that can be used in other game systems, such as but not limited to martial arts games and training, such as kick boxing, and the like.

Figure 6:
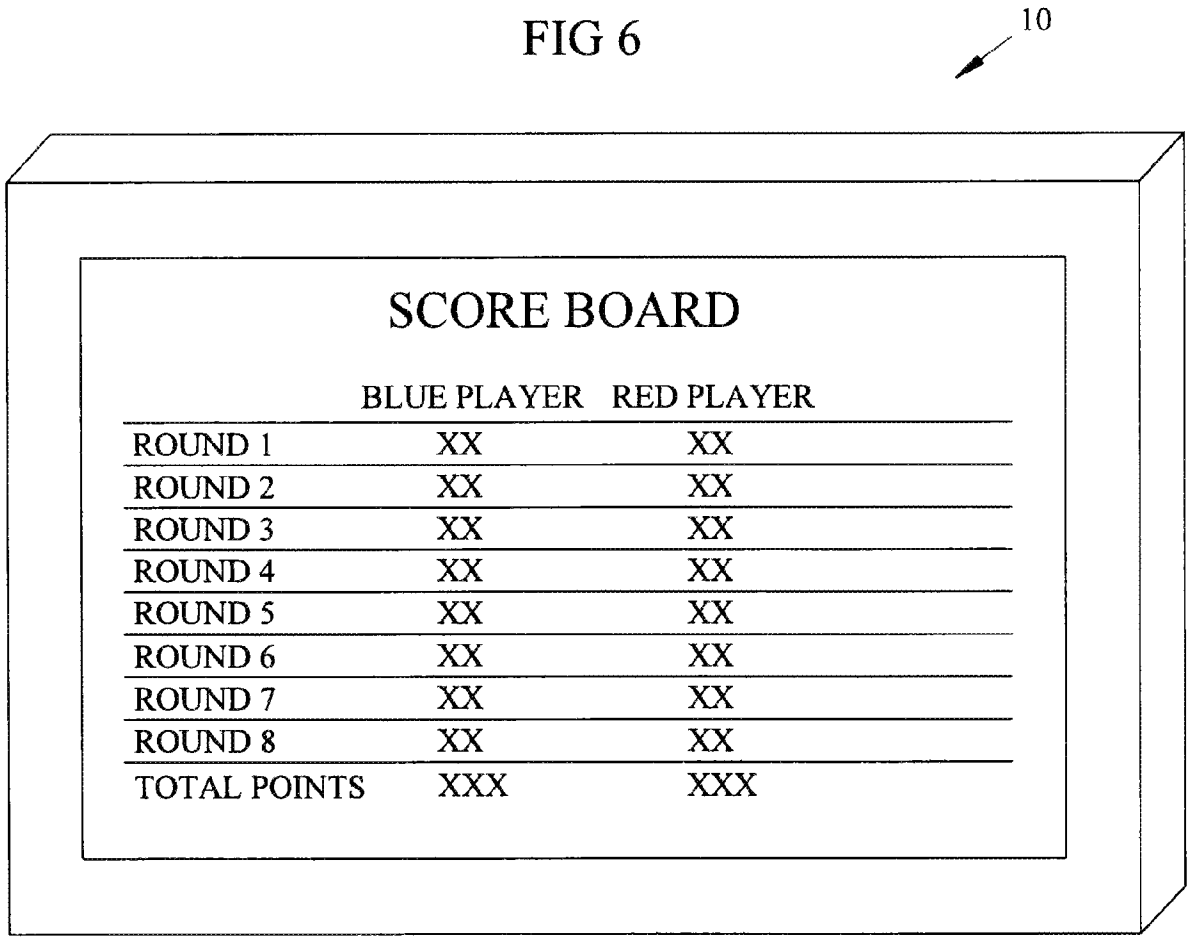
FIG. 6 is a front view of an electronic wireless scoreboard with display points.

FIG. 6 is a front view of an electronic wireless scoreboard 10 with display points. The scoreboard 10 can have a receiver with or without a computer that allows for the contact hit data sent from the sensor unit and transmitting unit 40 to be displayed.

Figure 7:
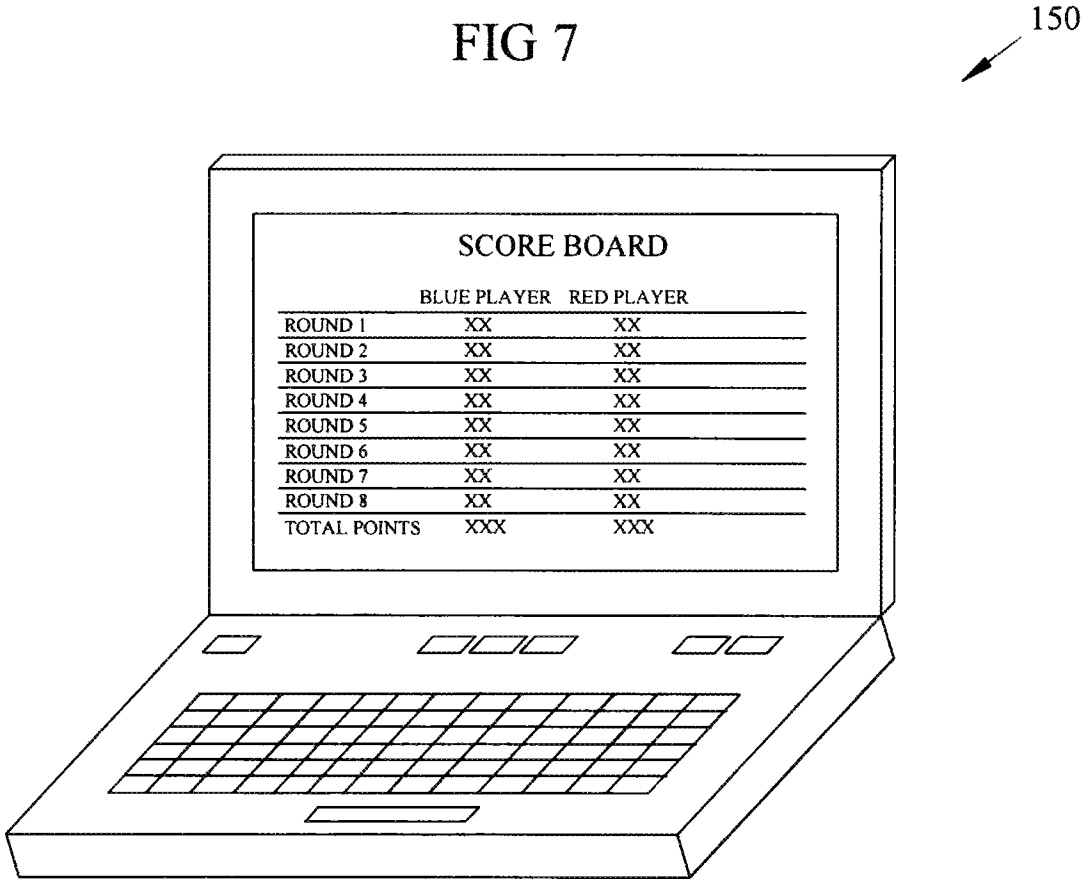
FIG. 7 is a front perspective view of laptop computer with scoring software installed.

FIG. 7 is a front perspective view of laptop computer 150 with scoring software installed.

Figure 8:
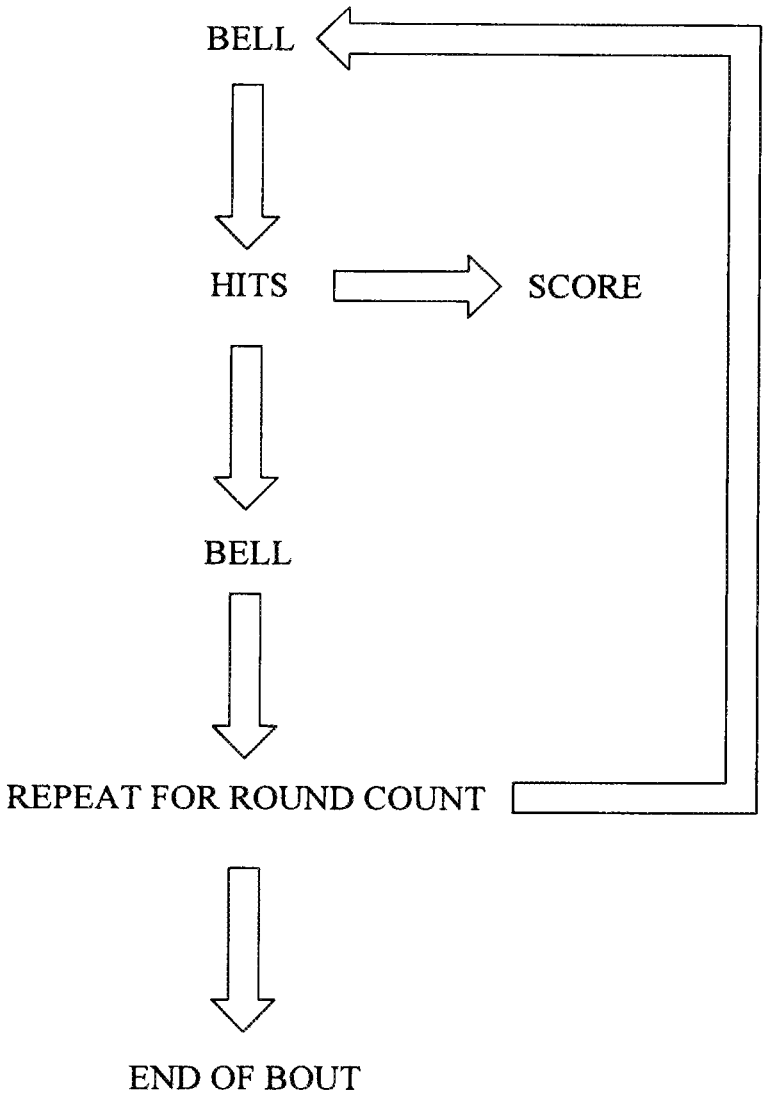
FIG. 8 is a flow chart showing sequence of game play.

FIG. 8 is a flow chart showing sequence of game play that can incorporate boxing game and training software.

Referring to FIGS. 1-4 and 6-8, at the start of a game or training session, a bell or other alarm (light and/or sound) can ring from the computer display, and then both participants 110A, 110B can try to make contacts at the different sensors 50. Points will be scored as the opponents make hitting contact with the sensors which are then tallied and displayed on the displays 10, 150. At the end of selected time periods a bell or other alarm (light and/or sound) will ring, and then the participants will repeat for the next round. This can repeat until a selected number of rounds as occurred.

The display can also include other types of computers, such as portable computers, and smart phones, and the like.

While the embodiments reference a combined sensor unit and transmitting unit that both counts the hits and transmits the compiled hit signals, the unit can also be only a transmitter which transmits the hits in real-time and the receiver can include a computer which tallies the hits. The sensors 50 can be adjusted so that sensors on the headgear cause different hit points than the sensors in the vests.

Although the invention describes the game and training as being used for boxing, the novel headgear and vest can be used for games and training in other sports, such as but not limited to kickboxing, Tai Kwon Do, Judo, fencing, and the like.

The invention can be used where different games, training programs, etc. can be downloaded from a remote website to the computer running the display. Additionally, the compact discs, and the like, can be used for different games, training programs, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A boxing game and training system, comprising:

a head gear having a cap portion adapted to cover a top of a participant's head, and side portions adapted to cover sides of the participant's head, the head gear adapted to expose a front of the participant's face so that the participant's nose and chin are not covered;

sensors on the side portions of the head gear;

a vest having a front portion and a rear portion, the front portion adapted to cover chest and stomach areas of the participant, the rear portion adapted to cover a back of the participant, wherein the rear portion of the vest includes a horizontal strap for attaching a left side of the vest to a right side of the vest, shoulder straps for attaching top left and top right portions of the vest to the horizontal strap, and a vertical strap that attaches bottom ends of the shoulder straps to the horizontal strap, and a mount on the vertical strap;

sensors on the vest;

a transmitter attached to the headgear sensors and to the vest sensors, the transmitter mounted on the mount on the vertical strap of the rear portion of the vest, so that the transmitter is adapted to be located in a central back portion of the participant;

a remote receiver for receiving wireless transmissions from any external contacts with the headgear sensors or with the vest sensors; and a remote display for displaying contact scores from the headgear sensors and from the vest sensors.

2. The boxing game and training system of claim 1, further comprising:

a second head gear having a cap portion adapted to cover a top of a second participant's head, and side portions adapted to cover sides of the second participant's head, the head gear adapted to expose a front of the second participant's face so that the second participant's nose and chin are not covered;

second sensors on the side portions of the second head gear;

a second vest having a front portion and a rear portion, the front portion adapted to cover chest and stomach area of the second participant, the rear portion adapted to cover a back of the participant, wherein the rear portion of the second vest includes a horizontal strap for attaching a left side of the second vest to a right side of the second vest, shoulder straps for attaching top left and top right portions of the second vest to the horizontal strap, and a vertical strap that attaches bottom ends of the shoulder straps to the horizontal strap, and a mount on the vertical strap;

second sensors on the second vest;

a second transmitter attached to the second headgear sensors and to the second vest sensors, the second transmitter mounted on the mount on the rear portion of the second vest; and a second remote receiver for receiving wireless transmissions from any external contacts with the headgear sensors or with the vest sensors, wherein the remote display displays contact scores from the second headgear sensors and the second vest sensors so that the transmitter is adapted to be located in a central back portion of the second participant.

3. The boxing game and training system of claim 2, wherein the remote display includes:

a raised display displaying boxing rounds and individual contact scores in each round.

4. The boxing game and training system of claim 2, wherein the remote display includes:

a portable computer with display displaying boxing rounds and individual contact scores in each round.

5. The boxing game and training system of claim 2, wherein the shoulder straps and the vertical strap in each vest form a Y shape, and the vertical strap and the horizontal strap in each vest have interlocking male and female connectors so that the vertical strap and horizontal strap can be separated from one another to allow for each vest to be easily put on and taken off by the participants.

6. The boxing game and training system of claim 4, wherein the portable computer includes:

a laptop computer.

7. The boxing game and training system of claim 4, wherein the portable computer includes:

a smart phone.

8. The boxing game and training system of claim 1, wherein the headgear includes an inverted U shape with the front of the participant's face left exposed.

9. The boxing game and training system of claim 1, wherein one of the headgear sensors is mounted on an exterior surface of a left side of the side portions of the headgear, and another one of the headgear sensors is mounted on an exterior surface of a right side of the side portions of the headgear.

10. The boxing game and training system of claim 1, wherein the vest sensors include:

a pair of upper vest sensors mounted on exterior surfaces of upper left and right front portions of the vest; and a pair of lower vest sensors mounted on exterior surfaces of lower left and right front portions of the vest.

11. The boxing game and training system of claim 1, wherein the shoulder straps and the vertical strap form a Y shape, and the vertical strap and the horizontal strap each have interlocking male and female connectors so that the vertical strap and horizontal strap can be separated from one another to allow for the vest to be easily put on and taken off by the participant.

12. A method for playing a boxing game, comprising the steps of:

providing a head gear having a cap portion adapted to cover a top of a participant's head, and side portions adapted to cover sides of the participant's head, the head gear adapted to expose a front of the participant's face so that the participant's nose and chin are not covered;

providing sensors on the side portions of the head gear;

providing a vest having a front portion and a rear portion, the front portion adapted to cover chest and stomach areas of the participant, the rear portion adapted to cover a back of the participant;

providing a horizontal strap for attaching a left side of the vest to a right side of the vest;

providing shoulder straps for attaching top left and top right portions of the vest to the horizontal strap;

providing a vertical strap that attaches bottom ends of the shoulder straps to the horizontal strap;

providing a mount on the vertical strap;

providing sensors on the vest;

providing a transmitter attached to the headgear sensors and to the vest sensors;

mounting the transmitter to the mount on the vertical strap on the rear portion of the vest;

providing a remote receiver for receiving wireless transmissions from any external contacts with the headgear sensors or with the vest sensors;

contacting the headgear sensors and the vest sensors from a second participant so that contact scores;

transmitting the contact scores to a remote receiver; and displaying the contact scores from the remote receiver on a display.

13. The method of claim 12, further comprising the steps of:

providing a second head gear having a cap portion adapted to cover a top of a second participant's head, and side portions adapted to cover sides of the second participant's head, the head gear adapted to expose a front of the second participant's face so that the second participant's nose and chin are not covered;

providing second sensors on the side portions of the second head gear;

providing a second vest having a front portion and a rear portion, the front portion adapted to cover chest and stomach area of the second participant, the rear portion adapted to cover a back of the participant;

providing a horizontal strap for attaching a left side of the second vest to a right side of the second vest;

providing shoulder straps for attaching top left and top right portions of the second vest to the horizontal strap;

providing a vertical strap that attaches bottom ends of the shoulder straps to the horizontal strap;

providing a mount on the vertical strap;

providing second sensors on the second vest;

providing a second transmitter attached to the second headgear sensors and to the second vest sensors;

mounting the second transmitter to the mount on the vertical strap on the rear portion of the second vest;

contacting the second headgear sensors and the second vest sensors from the participant so that contact scores;

transmitting the first contact scores to a second remote receiver; and displaying the second contact scores from the second remote receiver on the display.

14. The method of claim 13, further comprising the steps of:

displaying the first and the second contact scores for individual boxing rounds on the display.

15. The method of claim 13, further comprising the steps of:

providing the shoulder straps and the vertical strap of the first vest and the second vest to form a Y shape; and providing interlocking male and female connectors in the first vest and the second vest so that the vertical strap and horizontal strap can be separated from one another to allow for the vest to be easily put on and taken off by the participant.

16. The method of claim 14, further comprising the step of:

displaying the first and the second contact scores for the individual boxing rounds on a portable computer.

17. The method of claim 14, further comprising the step of:

displaying the first and the second contact scores for the individual boxing rounds on a smart phone.

18. The method of claim 12, further comprising the steps of:

providing the shoulder straps and the vertical strap to form a Y shape; and providing interlocking male and female connectors so that the vertical strap and horizontal strap can be separated from one another to allow for the vest to be easily put on and taken off by the participant.

* * * * *